US008871065B2

(12) United States Patent
Vacheron

(10) Patent No.: US 8,871,065 B2
(45) Date of Patent: Oct. 28, 2014

(54) EQUIPMENT FOR THE SURFACE TREATMENT OF PARTS BY IMMERSION IN A PROCESSING LIQUID

(75) Inventor: Frédéric Vacheron, Doussard (FR)

(73) Assignee: Tornos Management Holding SA, Moutier (CH)

( * ) Notice: Subject to any disclaimer, the term of this patent is extended or adjusted under 35 U.S.C. 154(b) by 405 days.

(21) Appl. No.: 12/442,322

(22) PCT Filed: Sep. 24, 2007

(86) PCT No.: PCT/IB2007/002775

§ 371 (c)(1),
(2), (4) Date: Mar. 20, 2009

(87) PCT Pub. No.: WO2008/035199

PCT Pub. Date: Mar. 27, 2008

(65) Prior Publication Data

US 2010/0024852 A1 Feb. 4, 2010

(30) Foreign Application Priority Data

Sep. 22, 2006 (FR) ..... 06 08407

(51) Int. Cl.

| | |
|---|---|
| ***C25D 17/28*** | (2006.01) |
| ***C25D 17/20*** | (2006.01) |
| ***C25D 17/00*** | (2006.01) |
| ***C25D 17/06*** | (2006.01) |
| ***C25D 21/10*** | (2006.01) |
| *C25D 5/08* | (2006.01) |

(52) U.S. Cl.

CPC ..... *C25D 17/20* (2013.01); *C25D 17/00* (2013.01); *C25D 17/06* (2013.01); *C25D 21/10* (2013.01); *C25D 5/08* (2013.01)

USPC ..... 204/198; 134/69; 204/199; 204/200; 204/212; 204/213; 204/215; 204/216; 204/217; 204/275.1

(58) Field of Classification Search

USPC ..... 204/198–200, 212–213, 215–217, 275; 205/143; 134/69

See application file for complete search history.

(56) References Cited

U.S. PATENT DOCUMENTS 1,442,514 A 1/1923 Bell
1,557,474 A * 10/1925 Farrand ..... 204/201

(Continued)

FOREIGN PATENT DOCUMENTS

CH 653 374 A 12/1985
DE 2 119 401 11/1972

(Continued)

*Primary Examiner* — Arlen Soderquist

(74) *Attorney, Agent, or Firm* — Frommer Lawrence & Haug LLP; Ronald R. Santucci

(57) ABSTRACT

The invention relates to an equipment for the surface treatment of parts (4), that comprises a plurality of treatment vats arranged in series and comprising rotating drums (2) provided with means for temporarily attaching the parts to be processed and having their axes (XX') rotatingly mounted horizontally so that the major portion of each drum (2) is submerged in the processing liquid contained in the corresponding vat, and a conveyor line (14) for supplying each drum (2) with parts to be processed and for removing from said drum the parts already processed, characterized in that the conveying process is carried out along a general axis (ZZ'), and in that the axes (XX') of the drums are parallel relative to each other and parallel to the general axis (ZZ') of the conveyor line.

11 Claims, 2 Drawing Sheets

(56) References Cited

U.S. PATENT DOCUMENTS

| | | | | | |
|---|---|---|---|---|---|
| 1,835,219 | A | * | 12/1931 | Hopkins | 134/69 |
| 1,997,013 | A | | 4/1935 | Potthoff | |
| 2,316,972 | A | | 4/1943 | Pond | |
| 3,771,649 | A | * | 11/1973 | Strauss | 209/3.1 |
| 3,849,284 | A | | 11/1974 | Kossmann | |
| 3,855,107 | A | * | 12/1974 | McInnes | 204/201 |
| 4,062,752 | A | * | 12/1977 | Peterson | 204/213 |
| 4,073,978 | A | * | 2/1978 | Womack et al. | 427/235 |
| 4,154,538 | A | * | 5/1979 | Linnhoff et al. | 366/188 |
| 4,282,825 | A | * | 8/1981 | Nagatomo et al. | 118/58 |
| 4,390,399 | A | * | 6/1983 | McInnes | 205/143 |
| 4,399,828 | A | * | 8/1983 | Kontos | 134/65 |
| 4,581,260 | A | | 4/1986 | Mawla | |
| 4,865,180 | A | * | 9/1989 | Brems et al. | 198/468.6 |
| 4,940,001 | A | * | 7/1990 | Holley | 104/307 |
| 5,012,918 | A | * | 5/1991 | Acker et al. | 198/465.4 |
| 5,415,890 | A | * | 5/1995 | Kloiber et al. | 427/242 |
| 5,798,039 | A | * | 8/1998 | Wiesemann | 210/232 |
| 5,817,220 | A | * | 10/1998 | Chen | 204/213 |
| 6,051,116 | A | * | 4/2000 | Ichinose et al. | 204/212 |
| 6,298,979 | B1 | * | 10/2001 | McNamara | 198/774.1 |
| 6,675,984 | B1 | * | 1/2004 | Jessup | 220/345.3 |
| 6,746,720 | B2 | * | 6/2004 | Nishida et al. | 427/430.1 |
| 7,026,015 | B2 | * | 4/2006 | Kreuzer | 427/425 |
| 7,066,187 | B2 | * | 6/2006 | Muller et al. | 134/65 |
| 2008/0257717 | A1 | | 10/2008 | Vacheron | |

FOREIGN PATENT DOCUMENTS

| | | | |
|---|---|---|---|
| DE | 29814487 | U | 1/1999 |
| EP | 1 433 537 | A | 6/2004 |
| GB | 726180 | | 3/1955 |
| JP | 63-310998 | A | 12/1988 |
| JP | 2-305999 | A | 12/1990 |
| JP | 2001-198508 | A | 7/2001 |
| JP | 2004-509745 | A | 4/2004 |
| WO | WO 2006/084973 | A | 8/2006 |

* cited by examiner

EQUIPMENT FOR THE SURFACE TREATMENT OF PARTS BY IMMERSION IN A PROCESSING LIQUID

This application is a 371 of PCT/IB2007/002775 filed on Sep. 24, 2007, published on Mar. 27, 2008 under publication number WO 2008/035199 A2 which claims priority benefits from French Patent Application Number 06 08407 filed Sep. 22, 2006, the disclosure of which is incorporated herein by reference.

The present invention relates to improvement in the surface treatment of parts using the principle of immersion in one or more treatment tanks and transfer of the parts between these tanks, especially the electrochemical surface treatment of metal parts, and more particularly a treatment of aluminum parts by anodization.

Examples of anodic treatments on aluminum and its alloys that may be mentioned include barrier or passivating anodization, porous anodization in an acid medium or anodic dissolution, or even electropolishing and hard or color anodizing.

The present invention relates especially to an improved treatment installation and more particularly an improved line for conveying the parts.

Installations for the surface treatment of aluminum parts operating by batches are already known. Document DE 2 119 401 describes such an installation, comprising motorized carriages travelling above several treatment vats. The carriages are provided with moveable arms undergoing vertical movements in order to immerse batches of objects to be treated into the successive vats and to extract them therefrom. Said document relates more specifically to a system for safely braking its carriages.

In French patent application 06/03687 and in patent application WO2006/00199, the content of which is incorporated here by reference, the applicants have already described installations for the surface treatment of parts that comprise a plurality of treatment tanks arranged in series and each equipped with a rotary drum that is provided with means for temporarily fastening the parts to be treated, the axis of said drum being mounted horizontally so as to rotate in such a way that most of each drum is immersed in a treatment liquid contained in the corresponding tank, and a conveying system intended to feed each drum with parts to be treated and to remove the already treated parts from said drum.

These parts are placed on cassettes, such as for example those disclosed in patent application EP-A-1 433 537, said cassettes being placed on the periphery of a pivoting drum. The conveying system comprises two parallel lines, arranged on either side of the tanks, the conveying axes of which are perpendicular to the axes of the rotary drums. Each cassette passes alternately from one line to the other after having passed through a treatment tank. This conveying system therefore requires a drive device for each line and several transfer devices between the lines and the tanks.

The present invention provides an improvement to the system for transferring the parts to be treated.

For this purpose, the invention provides an installation for the surface treatment of parts, comprising a plurality of treatment tanks arranged in series and equipped with rotary drums that are provided with means for temporarily fastening the parts to be treated, the axes of said drums being horizontally mounted so as to rotate in such a way that most of each drum is immersed in a treatment liquid contained in the corresponding tank, and a conveying line intended to feed each drum with parts to be treated and to remove already treated parts from said drum, in which installation said conveying takes place along a general axis, the axes of the drums being mutually parallel and parallel to the general axis of the conveying line.

Preferably, the axes of the drums are arranged to lie substantially in the same vertical plane and the general axis of the conveying line lies in the vertical plane containing the rotation axes of the drums.

According to one particular embodiment of the installation for the surface treatment of parts according to the invention, the periphery of a drum comprises a succession of slideways or of rails having axes parallel to the rotation axis of the drum, which are intended to accommodate cassettes supporting a number of parts to be treated, the cassettes being intended to perform, with the drum to which they are fastened, one complete revolution in the treatment liquid, whilst the conveying line is intended to feed the drum with cassettes of parts to be treated and to remove the cassettes of already treated parts from the drum, the conveying line lies above the tanks, and the general conveying axis is parallel to the rotation axis of the drums and lies in the vertical space containing the tanks.

In this installation, the drums may be arranged in such a way that their pairs of slideways that come momentarily into the upper position emerge from the treatment liquids and are aligned with one another, so that the transfers can take place simultaneously.

This installation may include transfer slideways placed between two successive tanks and aligned with the slideways of the drums in the upper position.

This installation may include means for spraying the parts in the region of the transfer slideways.

According to a preferred embodiment of the invention, the operations of transferring parts from the conveying line are timed and synchronous.

According to one embodiment of the invention, the conveying line includes at least one moveable carriage undergoing a reciprocating movement on a guide rail so as, by this movement, to cause one or more cassettes containing the already treated parts to be discharged by horizontal translation and one or more cassettes containing the as-yet untreated parts to be put into position, likewise by horizontal translation.

The moveable carriage may include a motor connected to a pinion cooperating with a rack so as to perform its reciprocating movements on the rail.

The underside of the carriage may include a horizontal control bar which carries at least one vertical arm terminating in an actuating part, while the control bar is retained on the underside of the carriage by means of two pivoting links, the pivoting of the links ensuring upward and downward movement of said bar.

Other features and advantages of the invention will emerge from the following description in conjunction with the appended drawings that are given merely by way of nonlimiting examples, in which.

Figure 1:
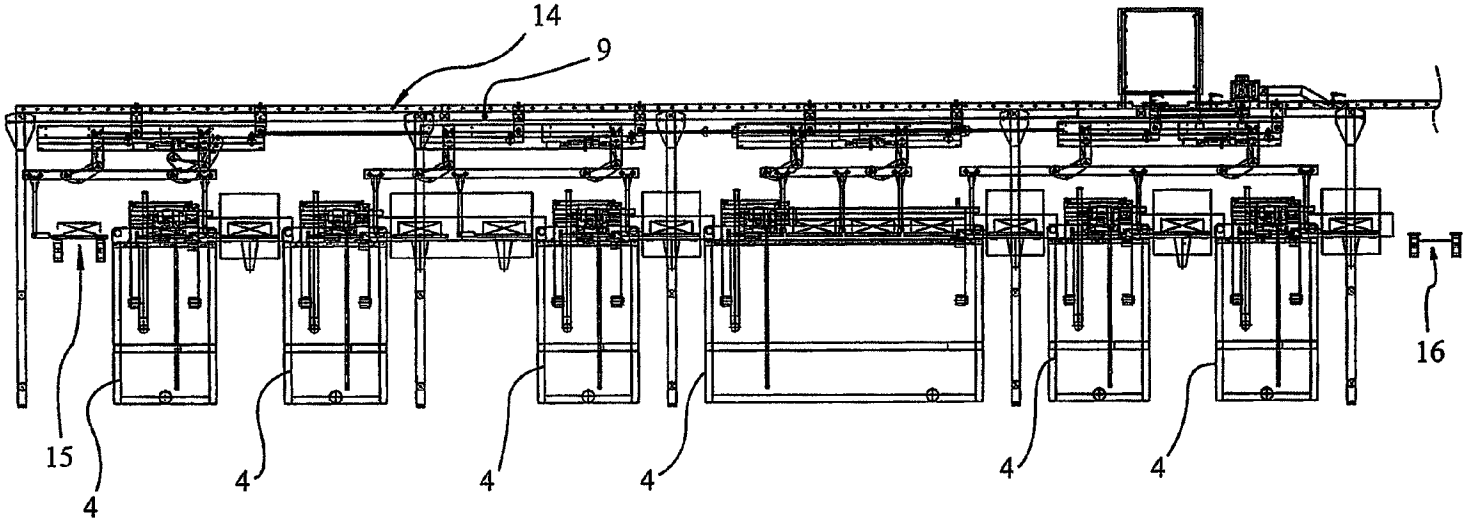
FIG. 1 is a side view of the installation.
Figure 2:
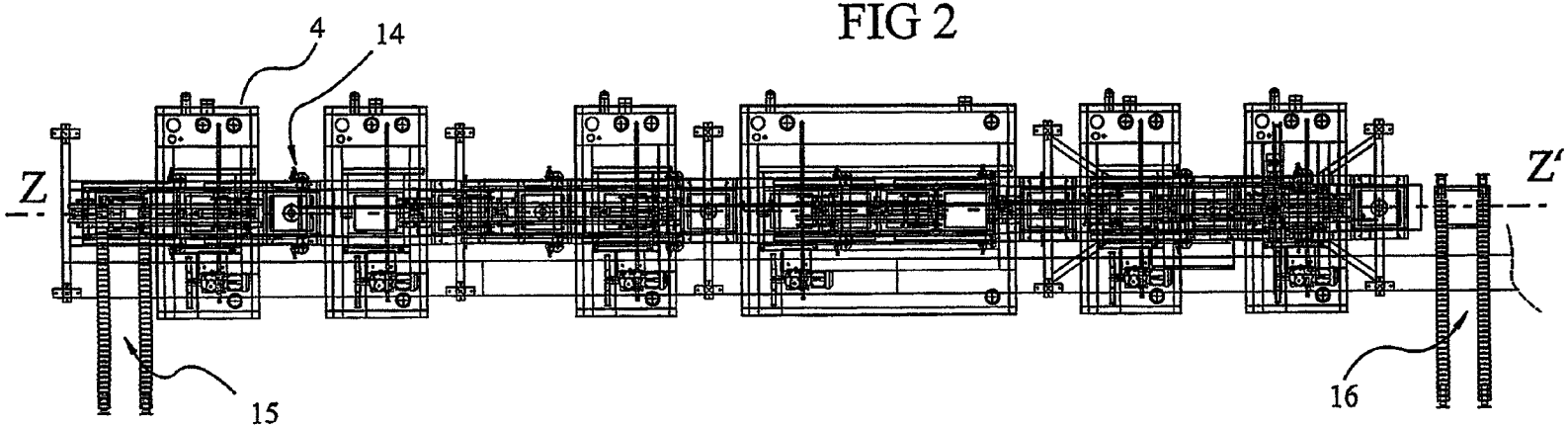
FIG. 2 is a top view of the installation.

FIGS. 1 and 2 illustrate an installation for the surface treatment of metal parts such as, for example, the anodization of aluminum parts, which requires a succession of tanks (4) containing different liquids, such as a degreasing liquid, a satinizing liquid, an electrolytic solution, a rinsing liquid, etc. One of the treatment tanks is filled with an electrolytic solution, for example sulfuric acid, and is used to anodize aluminum parts fastened to cassettes. For this type of treatment the tank comprises two electrodes, while the drum is supplied with electric current of opposite polarity to that of the electrodes, said electric current being transmitted to the parts to be treated via successively the drum and the cassettes, as described in the applicants' French patent application 06/03687, the content of which is incorporated here by reference. According to the process implemented by the treatment installation of the invention, each part is immersed in each tank, making it undergo at least one rotation movement such that the air bubbles and air pocket liable to be created inside the tank in contact with the part are expelled, thus enabling the treatment liquid to treat the entire surface of the part, making the treatment perfectly homogeneous.

A defined number of said parts to be treated are placed beforehand on a support or cassette (5) comprising at least one holding member capable of retaining each of them. The cassettes are for example those described in European patent application EP-A-1 433 537, which comprise a set of part-holding members enabling several parts to be fastened to a single cassette. The conveying line (14) comprises several carriages (9) so as to engage the cassettes of parts to be treated on the drums and to disengage the cassettes of treated parts from each of the drums.

Figure 3:
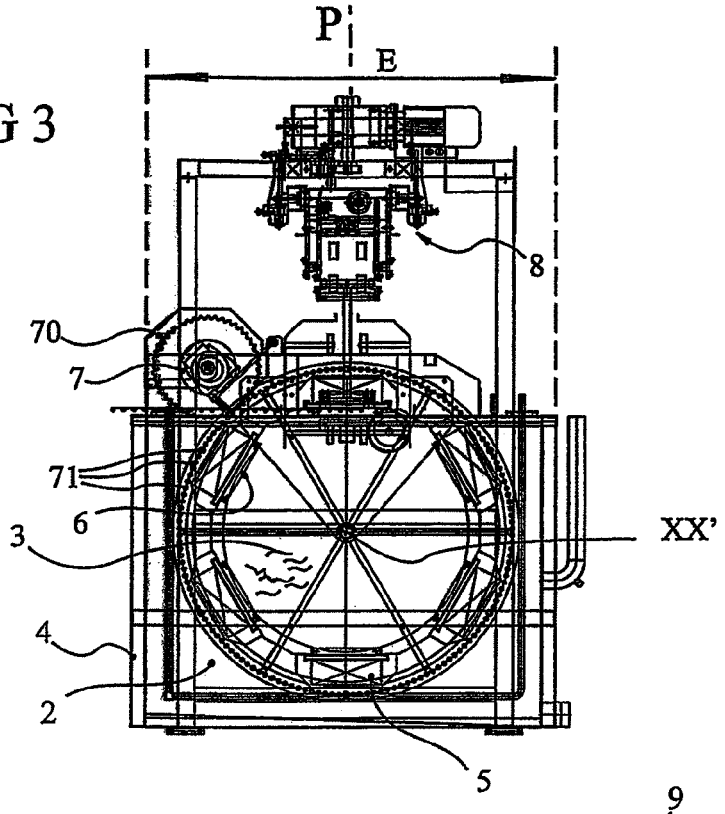
FIG. 3 is an end view of a tank with the conveying line.

As FIG. 3 illustrates, one or more complete 360° rotations are thus made, the parts (1) to be treated being fastened to the periphery of a drum (2) mounted so as to rotate in each treatment tank (4) about a horizontal axis (X, X'), said drum being immersed in the treatment liquid (3) contained in the tank (4), with the exception of its upper portion, which lies outside the liquid so as to allow the parts to be positioned and removed. According to the embodiment illustrated, the drum (2) comprises, on its external periphery, a succession of six pairs of slideways (6) intended to accommodate the cassettes (5) serving for supporting the parts to be treated. Thus, the cassettes comprising the as-yet untreated parts are engaged via horizontal displacement in the free, non-immersed, slideway placed at the top of the drum. The sliding axis of each of the slideways (6) is parallel to the rotation axis of the corresponding drum.

The tank (4) includes a motor (7) intended to rotate the pivoting drum (2) thanks to a toothed wheel (70) cooperating with a succession of pegs (71) mounted so as to be mutually parallel and between the two flanges of one of the sides of the drum, such as for example the drive ring, as described in French patent application 06/03687.

The conveying line assembly illustrated in FIGS. 1 and 2 operates by sequences of timed synchronous displacements. At each of the sequences in the five short tanks, a treated cassette is disengaged and a new, as-yet untreated cassette is engaged on a drum and then immersed during the rotation of the corresponding drum, in order to make a complete revolution, in the treatment liquid. In the 4th tank, which contains a drum having a length equivalent to four cassettes, these undergo four complete revolutions and four translations before being disengaged. The conveying line comprises a feed station (15), a disengagement station (16) and a zone for transfer between the 2nd and 3rd tanks, which zone is longer than the others and can be used as a station for spraying with a rinsing liquid.

For each tank, the conveying line (14) includes at least one associated moveable carriage (8), operating a limited reciprocating movement on a guide rail (9) so as to allow, by this reciprocating movement, one or more cassettes containing the already treated parts to be discharged and one or more cassettes containing the as-yet untreated parts to be engaged.

Each of the carriages (8) includes a motor connected to a pinion cooperating with a rack so as to perform its reciprocating movements on the rail.

On its underside, the carriage (8) includes a horizontal control bar (10) which includes at least one vertical arm (11*a*, 11*b*) for retaining an actuating part (12). This actuating part is intended to disengage, by sliding, the cassette of already treated parts, i.e. those that have made a complete revolution in the liquid, and to engage the next cassette of as-yet untreated parts. The control bar is retained on the underside of the carriage by means of two pivoting links (17*a*, 17*b*), the pivoting of the links ensuring vertical movement of the bar. Thanks to the pivoting links (17*a*, 17*b*), the control bar moves upward and downward parallel to itself.

Figure 4:
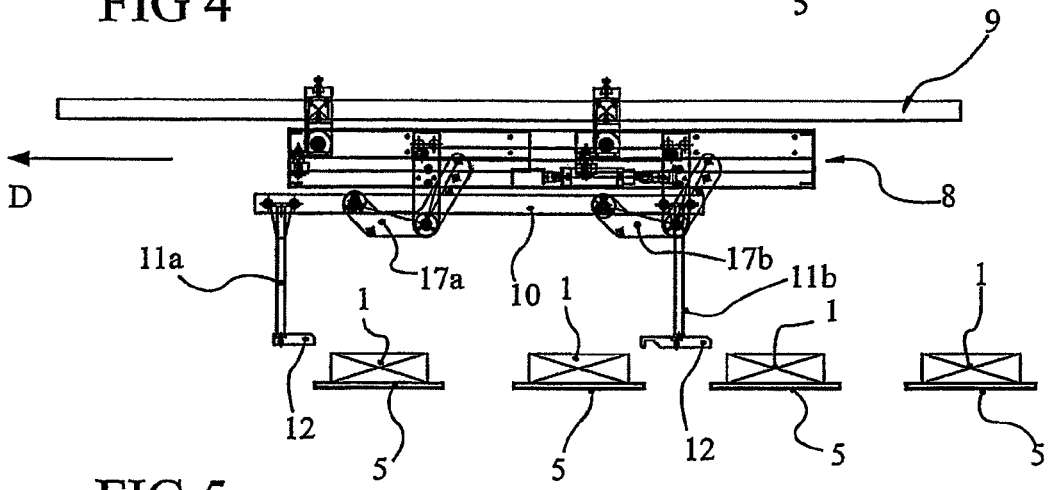
FIGS. 4 and 5 are detailed views of a moveable carriage of the conveying line in two different positions.
Figure 5:
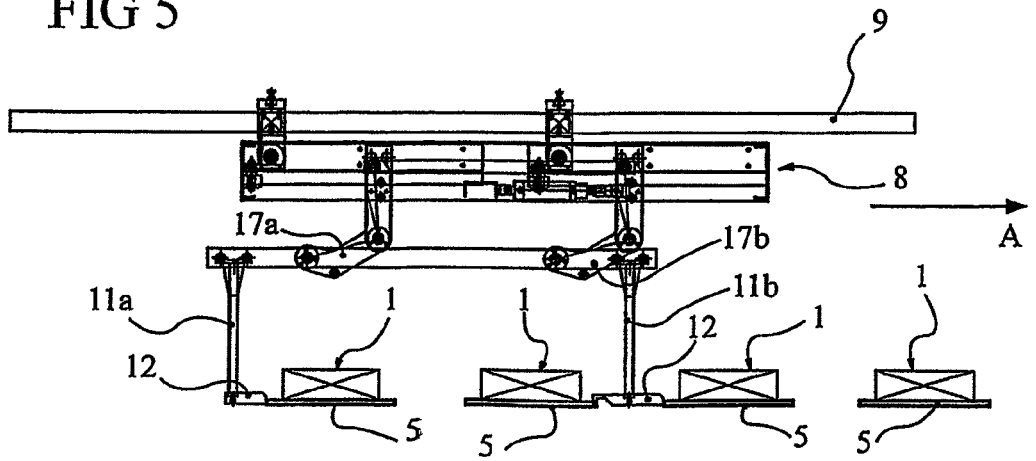

FIGS. 4 and 5 illustrate the operation of a moveable carriage (8). Thus, as illustrated in FIG. 4, the carriage (8) in the disengagement position is such that the horizontal bar (10) is in the disengagement high position, thereby enabling the carriage to move to the upstream end of the line, along the arrow D, for a new action. Once in the action position, the horizontal bar is moved downward, as illustrated in FIG. 5, so that the actuating part or parts 12 can come into the plane of the cassettes (5) and then the carriage (8) moves toward the downstream end of the line, along the arrow A, in the opposite direction to that (D) of disengagement, so as to engage a new cassette in the slideway (6) and forward a cassette by one position and/or disengage the cassette of already treated parts. It may be seen in FIG. 5 that the vertical arm (11*a*) pushes the left-hand cassette, while the vertical arm (11*b*) simultaneously pulls the second cassette and pushes the third cassette.

A person skilled in the art will in particular have deduced from the above description that, unlike in patent application WO 2006/00199, in which a double conveying line is provided, this being placed laterally and the general axis of which lies perpendicular to the rotation axis of the drums, in the installation of the invention the conveying line (14) lies above the tanks, and the general conveying axis is parallel to the rotation axis of the drums and lies in the vertical space (E) containing the tanks, and the general conveying axis (Z, Z') is parallel to the rotation axis of the drums and advantageously lies in the vertical plane (P) containing the rotation axis (X, X') of the drums.

Of course, the invention is not limited to the embodiment described and shown here by way of example; rather it encompasses many technical variants and combinations thereof.

Thus, FIG. 3 illustrates a drum with six cassette-fastening positions. This number could be different. By having for example only two fastening positions, it is possible to produce a smaller tank requiring little treatment liquid, in particular for a rapid treatment step. In this case, the structure of the drum is not necessarily cylindrical or hexagonal, but may be reduced to two arms. Thus, the respective durations of the successive treatment steps may be varied among themselves by virtue of having numbers of different fastening positions on the drums.

The conveying line could use only a single motor, the movements of all the moveable carriages taking place via a mechanical drive system.

The abovementioned cassettes are particularly suitable for the treatment of a large number of small parts. In the case of the treatment of large parts, these may be fastened directly to a drum or via fastening means other than slideways.

The invention claimed is:

1. An installation for a surface treatment of parts, comprising a plurality of treatment tanks arranged in series and equipped with rotary drums that are provided with means for temporarily fastening the parts to be treated, the axes of said drums being horizontally mounted so as to rotate and in such a way that most of each drum is immersed in a treatment liquid contained in the corresponding tank, and a conveying line intended to feed each drum with parts to be treated and to remove already treated parts from said drum, wherein the conveying line includes at least one movable carriage undergoing a reciprocating movement causing, by this movement, conveying said parts along a general axis and wherein the axes of the drums are mutually parallel and parallel to the general axis of the conveying line, wherein said means for temporarily fastening parts to be treated comprises at the periphery of each drum a number of slideways having axes parallel to the rotation axis of the drum, wherein all said drums are arranged in such a way that their slideways that come momentarily into the upper position emerge from the treatment liquids and that said slideways come simultaneously into the upper position and are aligned with one another, and wherein said conveying line is configured to operate synchronous and timed transfers of all of the parts located on said slideways that come into the upper positions, said transfers occurring simultaneously at all of said drums.

2. The installation for the surface treatment of parts as claimed in claim 1, wherein the rotation axes of the drums are arranged to lie substantially in a same vertical plane and wherein the general axis of the conveying line lies in the vertical plane containing the rotation axes of the drums.

3. The installation for the surface treatment of parts as claimed in claim 1, wherein said means for temporarily fastening parts to be treated comprises at the periphery of a drum a number of pairs of slideways having axes parallel to the rotation axis of the drum, which are capable to accommodate and fasten cassettes supporting a number of parts to be treated, the cassettes being intended to perform, with the drum to which they are fastened, one or more complete revolutions in the treatment liquid, wherein the conveying line is intended to feed the drum with cassettes of parts to be treated and to remove the cassettes of already treated parts from the drum and wherein the conveying line lies above the tanks and in the vertical space containing the tanks.

4. The installation for the treatment of parts as claimed in claim 3, wherein it includes transfer slideways placed between two successive tanks and aligned with those slideways of the drums momentarily in the upper position.

5. The installation for the treatment of parts as claimed in claim 4, wherein it includes means for spraying the parts in the region of at least one transfer slideway.

6. The installation for the surface treatment of parts as claimed in claim 4, wherein the conveying line includes at least one moveable carriage undergoing a reciprocating movement on a guide rail causing, by this movement, at least one cassette containing already treated parts to be discharged from one said drum and at least one cassette containing as-yet untreated parts to be engaged onto the said drum.

7. The installation for the surface treatment of parts as claimed in claim 6, wherein the moveable carriage includes a motor connected to a pinion cooperating with a rack so as to perform its reciprocating movements on the rail.

8. The installation for the surface treatment of parts as claimed in claim 7, wherein the underside of the carriage includes a horizontal control bar which carries at least one vertical arm for retaining an actuating part.

9. The installation for the surface treatment of parts as claimed in claim 8, wherein the control bar is retained on the underside of the carriage by means of two pivoting links, the pivoting of the links ensuring vertical movement of the bar.

10. The installation for the treatment of parts as claimed in claim 4, wherein the operations of transferring cassettes supporting parts from the transfer slideways of the conveying line to pairs of slideways of the drums and vice versa are timed and synchronous.

11. The installation for the treatment of parts as claimed in claim 3, wherein the operations of transferring cassettes supporting parts from the conveying line are timed and synchronous.

* * * * *